US006863977B2

(12) United States Patent
Ochi et al.

(10) Patent No.: US 6,863,977 B2
(45) Date of Patent: Mar. 8, 2005

(54) HIGHLY SHRINKABLE ACRYLIC FIBER, PILE COMPOSITIONS CONTAINING THE SAME AND NAPPED FABRICS MADE BY USING THE COMPOSITIONS

(75) Inventors: Ryo Ochi, Hiroshima (JP); Yasuji Inoue, Osaka (JP); Setsuo Hara, Hiroshima (JP); Yoshihiro Nishihara, Hiroshima (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 10/499,643

(22) PCT Filed: Dec. 26, 2002

(86) PCT No.: PCT/JP02/13602

§ 371 (c)(1),
(2), (4) Date: Jun. 28, 2004

(87) PCT Pub. No.: WO03/057953

PCT Pub. Date: Jul. 17, 2003

(65) Prior Publication Data

US 2005/0019562 A1 Jan. 27, 2005

(30) Foreign Application Priority Data

Dec. 28, 2001 (JP) ..... 2001-398925
Nov. 22, 2002 (JP) ..... 2002-339560

(51) Int. Cl.[7] ..... D01F 6/00; D01F 6/16; D05C 17/00

(52) U.S. Cl. ..... 428/364; 428/394; 428/92

(58) Field of Search ..... 428/364, 394, 428/92

(56) References Cited

U.S. PATENT DOCUMENTS

| | | | | | |
|---|---|---|---|---|---|
| 4,902,452 | A | * | 2/1990 | Nishihara et al. | 264/28 |
| 6,524,508 | B1 | | 2/2003 | Ohnishi et al. | 264/182 |
| 6,551,705 | B1 | * | 4/2003 | Ohnishi et al. | 428/372 |
| 6,610,403 | B1 | * | 8/2003 | Kasabo et al. | 428/397 |
| 6,696,156 | B2 | * | 2/2004 | Kasabo et al. | 428/400 |
| 6,733,881 | B2 | * | 5/2004 | Kasabo et al. | 428/364 |

FOREIGN PATENT DOCUMENTS

| | | |
|---|---|---|
| EP | 156102 | 10/1985 |
| JP | 4-119114 | 4/1992 |
| JP | 8-74119 | 3/1996 |
| JP | 10-237721 | 9/1998 |

* cited by examiner

*Primary Examiner*—N Edwards
(74) *Attorney, Agent, or Firm*—Oblon, Spivak, McClelland, Maier & Neustadt, P.C.

(57) ABSTRACT

There is disclosed a high-shrinkage acrylic fiber made of an acrylonitrile polymer comprising acrylonitrile in no less than 50% by weight, wherein a shrinkage rare after dry heating at 130° C. for 10 min without load is 25 to 35% and a difference between the maximum and the minimum of a shrinkage rate after dry heating within a temperature range of 120 to 140° C. for 10 min without load is 8% or less. There also provided a pile composition comprising the high-shrinkage acrylic in 20 to 80% by weight, and a pile fabric prepared from the pile composition.

22 Claims, No Drawings

HIGHLY SHRINKABLE ACRYLIC FIBER, PILE COMPOSITIONS CONTAINING THE SAME AND NAPPED FABRICS MADE BY USING THE COMPOSITIONS

TECHNICAL FIELD

This invention relates to a high-shrinkage acrylic fiber suitable for pile fabrics such as a boa and a high pile a pile composition comprising the highly shrinkable acrylic fiber; and a pile fabric from the pile composition.

BACKGROUND ART

An acrylic fiber is generally used for pile fabric such as boa and high-pile, because of the touch feeling and appearance pro vides animal-hair like texture and gloss and have been extensively used as a pile material for an animal-hair like pile fabrics cloth such as a boa and a high pile cloth. Among such pile fabrics, for example, pile portion of a high pile cloth generally has a double layer structure composed of guard hair and down hair. The double layer structure can be provided as follows. At first, raw staple fibers of guard hair and down hair are mixed to form a sliver, which is then knitted with ground yarn using the knitting machine to be knit structure. Then, a resin is applied to the back-face of the knitting fabric, and is cured by a heating apparatus known as a tenter. The shrinkage fiber for down hair shrinks during this curing process. Finally, the fiber for guard hair is extended by removing crimp in a polishing process. Therefore, a high shrinkage acrylic fiber is suitable for a staple fiber for down hair. Furthermore, it is necessary that a shrinkage fiber for down hair have a high shrinkage potential under the dry heat condition, because the curing is dry heating process.

There have been proposed a number of methods for preparing a high shrinkage acrylic fiber. For example, coagulated undrawn filaments obtained by wet spinning is drawn to 1.5 to 3 folds, then washed with water at a temperature of 70° C. or higher without tension, and are then subjected to secondary drawing to 1.5 to 2.5 folds, to provide such a fiber (e.g., see Japanese Patent Laid-open Publication No. 110910/1985; Patent Reference 1). Shrinkage level of the acrylic fiber is good in boiling water, but it is poor under a dry heating condition. There has been proposed a quick-shrinking acrylic fiber made of a polymer comprising 80% or more by weight of acrylonitrile and 5 to 15% by weight of a sulfonic-containing monomer and having a dry-heating shrinkage rate of no less than 30% under 10 min at 120° C. (e.g., see Japanese Patent Laid-open Publication No. 119114/1992; Patent Reference 2). Furthermore, there has been proposed a shrinkable staple fiber having 1 to 3 secondary crimps/inch with a shrinkage rate of no less than 15%, irrespective of dry or wet heating (e.g., see Japanese Patent Laid-open Publication No. 316750/1997; Patent Reference 3).

However, in a manufacturing process for a high pile fabric, there is two heating process, curing at the tenter and polishing. Usually the polishing temperature is higher than the curing one. For a conventional high shrinkage acrylic fiber described above, excessive shrinkage may occur during the polishing process. Consequently, it is difficult to provide a product having satisfactory properties in terms of softness and bulkiness. A process temperature in a tenter often varies depending on a processing rate and the type of the tenter. There are many product specifications for a high pile fabric depending on a wide variety of needs in the market.

Therefore, it isn't enough that a fiber for down hair simply has a high shrinkage potential, because shrinkage level is to be unevenness depending on temperature conditions in the tenter. As the results, product properties have not been met various requirements to individual high pile fabric.

On the other hand, a staple fiber for guard hair gives appearance and touch feeling like a natural fur to high pile fabric by removing crimp. Thus, a staple fiber for guard hair is preferably a fiber whose crimp can be easily removed by polishing. However, since a conventional acrylic fiber is generally dyed after crimping, it is difficult to remove crimp, which has been exposed to heat history at an elevated temperature during a dyeing process. Such a problem of difficulty in ruffle removing is generally solved by increasing the number of polishing in the polishing process or conducting polishing at a higher temperature. Such increase in a polishing number or temperature may cause ruffle removal in a down hair fiber in which ruffle removal is not necessary, often resulting in a product without bulkiness or high-quality texture.

<List of Prior Art>

Patent Reference 1: Japanese Patent Laid-open Publication No. 110910/1985

Patent Reference 2: Japanese Patent Laid-open Publication No. 119114/1992

Patent Reference 3: Japanese Patent Laid-open Publication No. 316750/1997.

DISCLOSURE OF THE INVENTION

We have investigated a staple fiber for a pile fabric, particularly thermal shrinking properties of a fiber used as a component for down hair under dry heating condition, as well as behavior of a pile composition in a manufacturing process for a pile fabric in which the fiber is used in the pile composition, and have finally achieved this invention. Objectives of this invention are to provide a high shrinkage acrylic fiber suitable as a down hair component which provides good touch feeling and fine appearance to a variety of pile fabric, where in a manufacturing process for the pile fabric, unevenness of shrinkage level of a fiber to be down hair at the curing (tenter) process and crimp removal in a down hair fiber during polishing can be prevented; to provide a pile composition comprising the highly shrinkable acrylic fiber; and to provide a pile fabric showing soft and good texture and fine appearance using the pile composition.

This invention provides a high shrinkage acrylic fiber made of an acrylonitrile polymer comprising an acrylonitrile unit in no less than 50% by weight, wherein a shrinkage rate of the fiber under dry heating condition at 130° C. for 10 min without load is 25 to 35% and a difference between the maximum and the minimum of a shrinkage rate under dry heating condition within a temperature range of 120 to 140° C. for 10 min without load is 8% or less. This invention also provides a pile composition comprising the high shrinkage acrylic fiber as described above in 20 to 90% by weight. This invention also provides a pile fabric prepared from the composition as described above.

BEST MODE FOR CARRYING OUT THE INVENTION

A high shrinkage acrylic fiber of this invention consists of an acrylonitrile polymer comprising no less than 50% by weight of acrylonitrile unit and exhibiting a thermal shrinking property that it has a shrinkage rate of 25 to 35% under dry heating condition at 130° C. for 10 min without load. The high shrinkage acrylic fiber is a useful down-hair component giving bulkiness and texture to a pile fabrics such as a double layer pile consisting of guard hair and down hair and a jacquard pile. If a shrinkage rate is too small, bulkiness and appearance of pile fabric product become poor. While if a shrinkage rate is too large, touch feeling of pile fabric product becomes too hard.

The highly shrinkage acrylic fiber of this invention exhibits a thermal shrinking property that it has a difference between the maximum and the minimum of a shrinkage rate under dry heating condition within a temperature range of 120 to 140° C. for 10 min without load is 8% or less, preferably 6% or less, more preferably 3% or less. If a difference between the maximum and the minimum is more than 8%, a double-layer structure of pile fabric cannot be clearly formed because of the unevenness of shrinkage rate for down hair fiber depend on tenter condition (e.g. temperature, time) or because of the removal of crimp from down hair fiber at polishing process under the excessive heating condition, resulting in a downgraded pile fabric.

The high shrinkage acrylic fiber of this invention preferably has an interfiber (fiber-fiber) coefficient of static friction $\mu s$ of 0.40 or less and an interfiber coefficient of dynamic friction $\mu d$ of 0.30 or less, and a difference between the coefficient of static friction $\mu s$ and the coefficient of dynamic friction $\mu d$, i.e., $\Delta\mu$ ($=\mu s-\mu d$) is 0.01 to 0.2. In the case that an interfiber coefficient of static friction $\mu s$ is 0.40 or less and an interfiber coefficient of dynamic friction $\mu d$ is 0.3 or less, fiber cohesion can be reduced during manufacturing a pile fabric and removal of crimp in a down hair fiber together with a guard hair fiber at polishing process can be avoided, so that a double layers structure of pile fabric can be clearly formed. Therefore, pile fabric using it have a good touch feeling and good appearance, resulting in a high-grade pile fabric.

A difference $\Delta\mu$ between interfiber coefficient of static friction and coefficient of dynamic friction also influences touch feeling of a pile fabric component. When $\Delta\mu$ is within a range of 0.01 to 0.2, the pile fabric become to have softness and silkiness to a pile. The $\Delta\mu$ may be adjusted within the range of 0.01 to 0.2 by, for example, controlling the cross-sectional shape and the surface morphology of the fiber and appropriately selecting and combining the types and the amount of oils applied. The oils are preferably lubricants including polyorganosiloxanes, higher alcohol esters, gly cerin esters and cationic surfactants.

In the high shrinkage acrylic fiber of this invention, number of crimps of filament "N (/inch)" is preferably 5 to 12, more preferably 6 to 10. Degree of crimp (percentage crimp) "D (%)" is preferably no less than 7, more preferably no less than 9. Since a too large degree of crimp may reduce mutual spreadability among fibers and thus tends to formation of fiber masses such as neps, it is preferably 20 or less. A product of N×D is preferably 50 or larger, more preferably 70 or larger. For preventing formation of fiber masses, it is preferably or less. When manufacturing a pile fabric using the high shrinkage acrylic fiber of this invention as a down hair component, a staple with a length of 32 mm or less is usually used as a down hair fiber for forming a double layer pile. Generally, it is difficult to make the sliver from such staple with a short length because of insufficient cohesion in a sliver.

Therefore, for the high shrinkage acrylic fiber of this invention, interfiber friction coefficients and a crimp property (morphology) can be controlled within the limits described above, to achieve sufficient cohesion in a sliver and thus to facilitate sliver formation even when a fiber length is short. Specifically, when forming a sliver using a staple with a length of 32 mm or less, a higher number of crimps N and a higher degree of crimp D is preferable. Thus, for forming a sliver, it is preferable to increase a crimp degree D when a crimp number N is smaller and to increase a crimp number N when a crimp degree D is smaller.

An acrylonitrile polymer constituting the high shrinkage acrylic fiber of this invention is a polymer prepared by polymerizing acrylonitrile and a monomer copolymerizable with acrylonitrile, which comprises 50% by weight or more of an acrylonitrile unit. A content of the acrylonitrile unit in the polymer is preferably 80% or higher, particularly 85% or higher and generally 99% or less.

A monomer copolymerizable with acrylonitrile is that having a copolymerizable double bond (hereinafter, referred to as a "vinyl monomer"); for example, acrylic and methacrylic acids and their alkyl esters, vinyl acetate, acryl amide, 2-hydroxyethyl methacrylate, 2-hydroxyethyl acrylate, glycidyl acrylate, glycidyl methacrylate, sodium allylsulfonate, sodium styrenesulfonate, vinyl chloride and vinylidene chloride. In the light of quality and a cost, vinyl acetate, vinyl chloride and methyl acrylate are preferable. When using a sulfonic-containing vinyl monomer, it can be preferably combined with another vinyl monomer as long as a content of the latter does not exceed 0.5% by weight.

These vinyl monomers can be used alone or in combination of two or more, and it is preferable to determine a polymer composition such that a glass transition temperature Tg of an acrylic fiber prepared is 90° C. or higher. If the glass transition temperature Tg is lower than 90° C., a crimp of a down hair fiber tends to be removed at a polishing process, resulting in deterioration in appearance and touch feeling of pile fabrics using the high shrinkage acrylic fiber of this invention as a down hair component.

An acrylonitrile polymer constituting the high shrinkage acrylic fiber of this invention may consist of a single polymer or a mixture of two or more polymers with different acrylonitrile contents, preferably a mixture of two or more polymers with different acrylonitrile contents.

More specifically, preferred examples of mixture of two or more polymers with different acrylonitrile contents as an acrylonitrile polymer include the mixture of acrylonitrile polymer (A) and acrylonitrile polymer (B) with mixture ratio of 0.2 to 1.5 (A/B, weight ratio), in which the acrylonitrile polymer (A) consists of 92 to 99% by weight of acrylonitrile and 1 to 8% by weight of a vinyl monomer copolymerizable with acrylonitrile and the acrylonitrile polymer (B) consists of 80% or more and less than 92% by weight of acrylonitrile and more than 8% and less than or equal to 20% by weight of a vinyl monomer.

Polymer (A) is effective for preventing from removal of crimp at a polishing process in manufacturing a pile product. If a content of the acrylonitrile unit is too small, it is ineffective for preventing hair extension and if it is too large, removal of crimp may be inhibited but high shrinkage cannot be achieved. A vinyl monomer copolymerizable with AN (acrylonitrile) is used for improving a solubility in a solvent during spinning, stability of a spinning dope and physical properties of the fiber. If it is less than 1% by weight, the spinning dope tends to form gel, leading to deteriorated operation stability. If it is more than 8% by weight, physical properties and heat resistance of the fiber may be deteriorated. When using a sulfonic group-containing vinyl monomer as an additional vinyl monomer, it is added for giving dye-affinity and gloss to the fiber. If its content is more than 0.5% by weight, a fiber elongation and spinning passage may be deteriorated and adhesion between fibers tends to occur during a spinning step. It is preferable to use it in a content of 0.5% by weight or less and to add another monomer.

Polymer (B) is used for achieving high shrinkage. If the content of an acrylonitrile unit is too small, texture of a pile product obtained may be deteriorated. If it is 92% or higher by weight, combination with polymer (A) is insignificant and high shrinkage cannot be achieved.

When the two or more polymers having different acrylonitrile unit contents (particularly preferably, polymers (A) and (B) described above) are present as a mixture in the acrylic fiber, high shrinkage can be achieved under dry heating condition and good appearance and soft feeling can be given to a pile product prepared. Preferably, mixing state of the polymer in a fiber should be as homogeneous as possible. If there is a part where individual polymers (for example, polymers (A) and (B)) are present such as side by side and a sheath core, unevenness of shrinkage or removal of crimp may be caused, resulting in a final pile product with insufficient appearance or touch feeling.

For achieving high shrinkage under dry heating condition and good appearance and soft feeling in a pile product, a mixing ratio by weight of polymer (A) and polymer (B) described above (A/B) is 0.2 to 1.5, preferably 0.5 to 1.0. If the mixing ratio (A/B) is too small, shrinkage under dry heating condition may be satisfactory, whereas in a polishing process in manufacturing a pile product, hair extension tends to occur, leading to poor product appearance and hard touch feeling. If the mixing ratio is too large, high shrinkage under dry heating condition cannot be achieved and appearance or touch feeling of a pile product is deteriorated.

When an acrylonitrile polymer constituting the high shrinkage acrylic fiber of this invention consists of three or more polymers with different acrylonitrile contents, an acrylonitrile unit in each polymer composition can be generally no less than 50% by weight, preferably no less than 80% by weight and the contents of the acrylonitrile unit can be determined in the consideration of the effect of removal of crimp, balance with high shrinkage properties and other physical properties in accordance with the two polymer mixture described above.

The highly shrinkable acrylic fiber of this invention may have any cross-sectional shape without limitations and may comprise appropriate agents such as an antiweathering agent, an antimicrobial agent, a pigment, a dye stuff, an antistatic, a electric conducting agent and a stainproofing agent.

The high shrinkage acrylic fiber of this invention can be prepared as described below. An acrylonitrile polymer comprising no less than 50% by weight of acrylonitrile is dissolved in a solvent to prepare a spinning dope. The acrylonitrile polymer may consist of a single polymer, a mixture of two or more polymers with different acrylonitrile contents, preferably a mixture of two or more polymers with different acrylonitrile contents. More specifically, it is preferable to use the mixture of acrylonitrile polymer (A) and acrylonitrile polymer (B) with mixture ratio of 0.2 to 1.5 (A/B, weight ratio) in which the acrylonitrile polymer (A) consists of 92 to 99% by weight of acrylonitrile unit and 1 to 8% by weight of a vinyl monomer unit copolymerizable with acrylonitrile and the acrylonitrile polymer (B) consists of 80% or more and less than 92% by weight of acrylonitrile unit and more than 8% and less than or equal to 20% by weight of a vinyl monomer unit.

The spinning dope thus prepared is discharged from a spinneret into a coagulation bath consisting of a solvent and water. The coagulated filaments are drawn by 2 to 6 folds in a hot water bath, followed by solvent removal from the filaments, finishing-oil application, collapsing and drying of the filaments. Furthermore, the filaments are relaxed and drawn at dry heating condition. Finally, the filaments can be ruffed such that a number of crimps "N (/inch)" is 5 to 12, a degree of crimp "D (%)" is 7 or higher and a product of N×D is 50 or higher, to provide the highly shrinkable acrylic fiber of this invention.

Thermal shrinkage of an acrylic fiber is significantly influenced by an acrylonitrile content, and a lower acrylonitrile content may tend to a higher shrinkage rate. However, a lower acrylonitrile content may tend to increase a shrinkage rate difference depend on heating temperature so that a working range for preparing a staple fiber as a down hair component having shrinkage properties used for manufacturing a pile fabric becomes very narrow. Thus, an acrylonitrile content is preferably 85% or higher by weight while controlling spinning conditions. In terms of drawing at dry heating condition, when a drawing rate is low, a desired shrinkage rate cannot be achieved, while when an drawing rate is high, a shrinkage rate difference depend on heating temperature tends to be increased, depending on an acrylonitrile content in the polymer and a shrinkage rate may be reduced due to filament damage. Therefore the drawing rate is preferably 1.6 to 2.5.

Examples of a solvent used for manufacturing the highly shrinkable acrylic fiber of this invention include, but not limited to, organic solvents such as dimethylacetamide and dimethyl sulfoxide. There are also no particular restrictions to a polymer concentration in the spinning dope. In terms of crimping the highly shrinkable acrylic fiber, desired number of crimps N (/inch) and degree of crimp D (%) may be provided by using a stuffing box type crimper and controlling a nip pressure and a clapper (stuffing box) pressure as appropriate.

The high shrinkage acrylic fiber of this invention is suitably used as a component for a pile fabric; particularly as a down hair component in pile fabric such as a boa and a high pile having a double layer. For effectively achieving good appearance and touch feeling when manufacturing a pile fabric using the high shrinkage acrylic fiber of this invention as a down hair component, it is necessary that a pile material comprising a high shrinkage down hair component is a pile composition comprising the highly shrinkable acrylic fiber of this invention in 20 to 90% by weight.

If the content of the high shrinkage acrylic fiber of this invention in the pile composition is too small, it cannot effectively act as down hair constituting the pile, leading to insufficient bulkiness. If it is too large, touch-feeling of the pile fabric becomes rough and hard. A range of 20% by weight to 90% by weight is, therefore, particularly preferable.

A pile composition consists of the high shrinkage acrylic fiber of this invention and a low shrinkage fiber as a guard hair component, in which the low shrinkage fiber is contained in 80 to 10% by weight. There are no particular restrictions to the material of the low shrinkage fiber constituting the pile composition together with the high shrinkage acrylic fiber of this invention as long as it shows a shrinkage rate different by 10% or more from that for the high shrinkage acrylic fiber of this invention under dry heating condition at 130° C. for 10 min without load; for example, synthetic fibers such as acrylic fibers, polyamide fibers, polyester fibers, vinyl chloride fibers, polypropylene fibers and polyethylene fibers; semisynthetic fibers such as rayons and acetates; and natural fibers such as cotton and wool. These can be used alone or in combination of two or more.

In particular, when using an acrylic fiber as a low shrinkage fiber together with the high shrinkage acrylic fiber of this invention as pile composition components, it is preferable to use a low shrinkage acrylic fiber with a shrinkage rate of 5% or less under dry heating condition at 130° C. for 10 min without load as the low shrinkage acrylic fiber. By using a pile composition comprising such a low shrinkage acrylic fiber in 80 to 10% by weight, good color development property of an acrylic fiber can be more effectively achieved and a soft and bulky pile fabric can be obtained. The pile composition can be mixed with staple fibers for individual fibers and further can be used as a sliver.

Furthermore, when the above preferable low shrinkage acrylic fiber is a modified cross-section fiber, a pile fabric may be given with various touch feelings. For example, when giving a pile fabric with soft touch feeling like animal-hair, a flat cross-section fiber is used while when giving it silkiness, a dog bone (dumbbell) type or U-shaped cross-section fiber is used. When giving further voluminousness, a Y-shaped or cross-shaped cross-section fiber is used and when giving gloss in an appearance, a flat cross-section fiber is used, which has a flat side of 25 μm or more with no concaves with a depth of more than 0.3 μm along longitudinal direction in the fiber cross-section.

A pile fabric from such a pile composition can be manufactured by conventionally known procedures and apparatuses. In a tenter treatment step in manufacturing a pile fabric, a high shrinkage acrylic fiber as a down hair component in a pile composition is shrunken to be down hair and in a polishing process, crimp of non-highly shrinkage fiber as a guard hair component is removed without removing crimp in the down hair, to give soft and good touch feeling and fine appearance.

EXAMPLES

This invention will be more specifically described with reference to Examples. In these examples, dry-heating shrinkage rates and glass transition temperatures Tg were measured by the method described below and the appearance and touch feeling of high pile cloth were evaluated by visual test and by handling (contact) test, respectively.

<Dry-heating Shrinkage Rate>

A fiber was kept under a dry heating atmosphere at 130° C. or at an appropriate temperature within the range of 120 to 140° C. for 10 min without load, i.e., was dry heated, and then a dry-heating shrinkage rate was calculated according to the following equation:

$$\text{Dry-heating shrinkage rate (\%)}=[(L_0-L_1)/L_0]\times 100$$

wherein $L_0$ and $L_1$ are fiber lengths before and after dry heating, respectively.

<Glass Transition Temperature Tg>

A fiber was cut into chips to prepare a sample, which was then subjected to DSC measurement under the conditions described below, to determine a glass transition temperature.

Apparatus: Seiko Instruments, Inc DSC 220C

Temperature profile: heating to 30° C., heating to 150° C., quenching to 30° C. and then heating to 300° C.;

Rate of temperature rise: 10° C./min.

<Interfiber (Fiber—Fiber) Coefficients of Static Friction and of Dynamic Friction>

Determined according to JIS L1015, Roder method.

<Number of Crimps N (/inch) and Degree of Crimp D (%)>

Determined according to JIS L1015, 7.12.

<Appearance Evaluation>

Appearance of a high pile cloth was visually evaluated according to the following rating criteria, where "Very good" means fiber unevenness was not observed in a down hair portion and "Bad" means significant unevenness was observed.

⊙: Very good, o: Good, Δ: Slightly bad, x: Bad

<Touch-Feeling Evaluation>

Texture of a high pile cloth was evaluated by handling according to the following rating criteria, where "Very good" means sufficient softness and voluminousness were observed and "Bad" means roughness and hardness were observed.

⊙: Very good, o: Good, Δ: Slightly bad, x: Bad

Examples 1 to 4 and Comparative Examples 1 to 4

A single polymer or polymer mixture having a composition shown in Table 1 was dissolved in dimethylacetamide and then to the solution was added a coloring agent to prepare a spinning dope with a polymer concentration of 25% by weight. The spinning dope was extruded through spinnerets into a coagulation bath of a 50% by weight aqueous solution of dimethylacetamide at a bath temperature of 40° C. The coagulated fibers were drawn to a drawing rate shown in Table 1 in the drawing-washing bath. Then, a finishing oil comprising a 60% by weight or more of cationic surfactant as a lubricant was added to the fibers, which were then dried and collapsed. The fibers were relaxed in a pressurized steam and then were drawn under dry heating condition to the drawing rate shown in Table 1, using a dry-heating roller at 120° C. Subsequently, the fibers were mechanically crimped and fibers with a monofilament size of 4 dtex were obtained.

TABLE 1

| | Polymer composition (weight ratio) | | Drawing rate (fold) | |
|---|---|---|---|---|
| | Polymer A | Polymer B | Drawing in a bath | Dry-heating Drawing |
| Example 1 | AN91/AV9 = 100 | — | 4 | 2 |
| Example 2 | AN94/AV6 = 50 | AN90/AV10 = 50 | 4 | 2 |
| Example 3 | AN94/AV6 = 50 | AN90/AV10 = 50 | 3 | 2 |
| Example 4 | AN50/VCl50 = 100 | — | 3 | 2 |
| Comp. Ex. 1 | AN90/AV10 = 100 | — | 3 | 2 |
| Comp. Ex. 2 | AN90/AV10 = 100 | — | 3 | 2.5 |
| Comp. Ex. 3 | AN91/AV9 = 100 | — | 6 | 1.5 |
| Comp. Ex. 4 | AN96/AV4 = 100 | — | 4 | 1.5 |

*AN: acrylonitrile, AV: vinyl acetate, VCl: vinyl chloride

Table 2 shows dry-heating shrinkage rates, shrinkage rate differences, glass transition temperatures (Tg) and interfiber coefficients of static friction (μs) and of dynamic friction (μd), as well as friction differences (Δ=μs−μd). Table 3 shows number of crimps N (/inch), degree of crimp D (%) and products of N×D.

TABLE 2

| | Dry heating at 130° C. Shrinkage rate (%) | Shrinkage difference by dry heating at 120 to 140° C. (%) | Tg | Friction coefficient μs | μd | Δμ |
|---|---|---|---|---|---|---|
| Ex. 1 | 34.2 | 5.5 | 90.6 | 0.374 | 0.261 | 0.113 |
| Ex. 2 | 29.0 | 2.6 | 94.2 | 0.285 | 0.253 | 0.032 |
| Ex. 3 | 27.0 | 2.8 | 94.2 | 0.338 | 0.256 | 0.082 |
| Ex. 4 | 31.0 | 3.0 | 92.6 | 0.357 | 0.267 | 0.090 |
| Comp. Ex. 1 | 33.8 | 9 | 90.1 | 0.336 | 0.277 | 0.059 |
| Comp. Ex. 2 | 35.2 | 10 | 90.1 | 0.400 | 0.263 | 0.137 |
| Comp. Ex. 3 | 22.0 | 2.5 | 90.1 | 0.396 | 0.222 | 0.174 |
| Comp. Ex. 4 | 20.0 | 1.5 | 94.0 | 0.378 | 0.274 | 0.104 |

TABLE 3

| | Number of crimps N | Degree of crimp D | N × D |
|---|---|---|---|
| Example 1 | 6.3 | 8.6 | 54.2 |
| Example 2 | 7.7 | 10.8 | 83.2 |
| Example 3 | 9.4 | 12.0 | 112.8 |
| Example 4 | 6.5 | 9.0 | 58.5 |

The highly shrinkable acrylic fiber of this invention thus obtained was cut into short fibers with a length of 32 mm. The short fibers and Funcle (Mitsubishi Rayon Inc., acrylic staple fiber; a shrinkage rate under dry heating condition at 130° C. for 10 min without load: 3% or less; a monofilament size: 11 dtex, a cut length: 51 mm) were blended in the amounts of 40% by weight and 60% by weight, respectively, to prepare staple fibers for a pile. A sliver was prepared from the staple fibers. The sliver was processed with a ground yarn polyester filament 150 dtex/48f to be a ground fabric by a sliver knitting machine, to prepare a sliver knit. The back-face side of the sliver knit was processed with a resin and cured under dry heating condition at 130° C. by a tenter, then the surface was polished under the dry-heating atmosphere at 170 to 90° C. and shirred, to provide a pile fabric with a pile height of 18 mm. The pile fabric thus obtained was evaluated for its appearance and touch feeling. The evaluation results are shown in Table 4. The pile fabric prepared in Examples 1 to 4 were high pile fabric having a pile side with a dear double layer structure with a height difference of 5 mm between down hair and guard hair.

TABLE 4

| | Pile appearance | Pile touch-feeling | Overall evaluation |
|---|---|---|---|
| Ex. 1 | ◎ | ○ | ◎ |
| Ex. 2 | ◎ | ◎ | ◎ |
| Ex. 3 | ○ | ◎ | ◎ |
| Ex. 4 | ○ | ◎ | ◎ |
| Comp. Ex. 1 | Δ | X | Δ |
| Comp. Ex. 2 | X | Δ | Δ |
| Comp. Ex. 3 | X | Δ | X |
| Comp. Ex. 4 | X | Δ | X |

<Examples 5 and 6 and Comparative Examples 5 and 6>

The short fiber of the highly shrinkable acrylic fiber of this invention prepared in Example 2 (cut length: 32 mm) and Funcle (Mitsubishi Rayon Inc., acrylic staple fiber; a shrinkage rate under dry heating at 130° C. for 10 min without load: 3% or less; a monofilament size: 11 dtex, a cut length: 51 mm) were blended in a weight ratio shown in Table 5, to prepare staple fibers for a pile. A pile fabric with a pile height of 18 mm was prepared by the same manufacturing process as described in Example 1. The pile fabric thus obtained was evaluated for its appearance and touch-feeling. The evaluation results are shown in Table 5. The pile fabric prepared in Examples 5 and 6 were high pile fabric having a pile portion with a dear double layered structure with a height difference of 5 mm between down hair and guard hair.

TABLE 5

| | Highly shrinkable acrylic fiber of the invention (wt %) | Low shrinkable acrylic fiber (wt %) | Pile appearance | Pile texture-feeling |
|---|---|---|---|---|
| Ex. 5 | 40 | 60 | ◎ | ◎ |
| Ex. 6 | 70 | 30 | ○ | ○ |
| Comp. Ex. 5 | 10 | 90 | X | X |
| Comp. Ex. 6 | 95 | 5 | X | X |

<Examples 7 and 8>

Polymers A and B having the composition shown in Table 6 were mixed and dissolved in dimethylacetamide in a weight ratio shown in Table 6, to prepare a spinning dope with a polymer concentration of 25%. It was spinned by a wet spinning method where the spinning dope was extruded through a spinneret into a coagulation bath of a 50% aqueous solution of dimethylacetamide at a bath temperature of 40° C. This fiber was dried, collapsed and relaxed under pressurized steam at 135° C. and drawn with a drawing rate of 1.8 using a dry heating roller at 120° C. Then, a mechanical crimp was added to prepare fibers with a monofilament size of 4 dtex.

TABLE 6

| | Polymer composition (wt %) A | B | Weight ratio (A/B) |
|---|---|---|---|
| Example 7 | AN/AV = 93/7 | AN/AV = 91/9 | 1.0 |
| Example 8 | AN/AV = 93/7 | AN/AV = 91/9 | 0.45 |

AN: acrylonitrile, AV: vinyl acetate

Table 7 shows a dry-heating shrinkage rate, a temperature at a maximum thermal shrinkage stress and a maximum thermal shrinkage stress for the acrylic fiber obtained. The acrylic fibers of this invention prepared were cut into staple fibers with a length of 32 mm. The staple fibers and Funcle (Mitsubishi Rayon Inc., acrylic staple fiber; a shrinkage rate under dry heating condition at 130° C. without load: 3%; a monofilament size: 11 dtex, a cut length: 51 mm) were blended in the amounts of 40% by weight and 60% by weight, respectively, to prepare a staple fibers for a pile. A sliver knit was prepared from the staple fibers by a sliver knitting machine. The sliver knit was backing cured at 130° C. and polished at 170° C. to provide a high pile product having a double layered structure pile of down hair from the thermally shrinkable acrylic fibers by shrinking and guard hair from Funcle without shrinkage. The high pile product thus obtained was evaluated for its appearance and touch feeling. The results are shown in Table 8.

TABLE 7

| | Shrinkage rate (%) Under dry heating at 130° C. | Temp. at the maximum thermal shrinkage stress (° C.) | Maximum thermal shrinkage stress (mg/dtex) |
|---|---|---|---|
| Example 7 | 30.0 | 99 | 160 |
| Example 8 | 32.0 | 100 | 155 |

TABLE 8

| | Product processability | | Pile product | | |
|---|---|---|---|---|---|
| | Dry heating shrinking property | Hair extension in a polisher | Appearance | Texture-feeling | Overall evaluation |
| Example 7 | Good | None | ◎ | ◎ | ◎ |
| Example 8 | Good | None | ◎ | ◎ | ◎ |

<Examples 9 and 10>

Staple fibers with a cut length of 32 mm from the acrylic fiber of this invention prepared in Example 7 and Funcle (Mitsubishi Rayon) were blended in a weight ratio shown in Table 9 for a pile. From the staple fibers, a sliver knit was prepared by a sliver knitting machine, and a high pile product was prepared as described in Example 1. The pile products thus prepared were evaluated for its appearance and touch feeling. The results are shown in Table 9.

TABLE 9

| | Acrylic fiber of this invention | Fankle | Pile appearance | Pile texture |
|---|---|---|---|---|
| Example 9 | 40% | 60% | ◎ | ◎ |
| Example 10 | 70% | 30% | ○ | ○ |

INDUSTRIAL APPLICABILITY

The high shrinkage acrylic fiber of this invention exhibits excellent shrinking properties under a dry heating condition and is a pile fabric such as a boa, a high pile cloth and mat with soft and excellent touch feeling and fine appearance. It is particularly suitably used for a pile composition which is to be combined with a non-high shrinkage fiber. A pile fabric prepared from a pile composition comprising the high shrinkage acrylic fiber of th is invention exhibits soft and excellent feeling and fine appearance.

What is claimed is:

1. A high-shrinkage acrylic fiber made of an acrylonitrile polymer comprising an acrylonitrile unit in 50% by weight or more, wherein a shrinkage rate of the fiber under dry heating condition at 130° C. for 10 min without load is 25 to 35% and a difference between the maximum and the minimum of a shrinkage rate under dry heating condition within a temperature range of 120 to 140° C. for 10 min without load is 8% or less.

2. The high-shrinkage acrylic fiber as claimed in claim 1 wherein an interfiber coefficient of static friction $\mu s$ is 0.4 or less; an interfiber coefficient of dynamic friction $\mu d$ is 0.30 or less; and $\Delta\mu$, a difference between the coefficient of static friction $\mu s$ and the coefficient of dynamic friction $\mu d$, is 0.01 to 0.2.

3. The high-shrinkage acrylic fiber as claimed in claim 1, wherein a number of crimps N/inch of a monofilament is 5 to 12; its degree of crimp D (%) is 7 or higher; and a product of N×D is 50 or larger.

4. The high-shrinkage acrylic fiber as claimed in claim 1, wherein the acrylonitrile polymer is a single polymer or a mixture of two or more polymers with different acrylonitrile content.

5. The high-shrinkage acrylic fiber as claimed in claim 2, wherein the acrylonitrile polymer is a single polymer or a mixture of two or more polymers with a different acrylonitrile content.

6. The high-shrinkage acrylic fiber as claimed in claim 3, wherein the acrylonitrile polymer is a single polymer or a mixture of two or more polymers with a different acrylonitrile content.

7. The high-shrinkage acrylic fiber as claimed in claim 4, wherein an acrylonitrile content of the acrylonitrile polymer is 80% by weight or higher.

8. The high-shrinkage acrylic fiber as claimed in claim 5, wherein an acrylonitrile content of the acrylonitrile polymer is 80% by weight or higher.

9. The high-shrinkage acrylic fiber as claimed in claim 6, wherein an acrylonitrile content of the acrylonitrile polymer is 80% by weight or higher.

10. The high-shrinkage acrylic fiber as claimed in claim 1, wherein the acrylonitrile polymer is prepared by copolymerization of acrylonitrile with a monomer copolymerizable with acrylonitrile; and the copolymerizable monomer is selected from the group consisting of acrylic acid, methacrylic acid and their alkyl esters, vinyl acetate, acryl amide, 2-hydroxylethyl methacrylate, 2-hydroxylethyl acrylate, glycidyl acrylate, glycidyl methacrylate, sodium allylsulfonate, sodium styrenesulfonate, vinyl chloride and vinylidene chloride.

11. A pile composition comprising the high-shrinkage acrylic fiber as claimed in claim 1 in an amount of 20 to 90% by weight.

12. A pile composition comprising the high-shrinkage acrylic fiber as claimed in claim 2 in an amount of 20 to 90% by weight.

13. A pile composition comprising the high-shrinkage acrylic fiber as claimed in claim 3 in an amount of 20 to 90% by weight.

14. The pile composition as claimed in claim 11, further comprising a low shrinkable acrylic fiber whose shrinkage rate after dry heating at 130° C. for 10 min without load is 5% or less in an amount of 80 to 10% by weight.

15. The pile composition as claimed in claim 12, further comprising a low shrinkable acrylic fiber whose shrinkage rate after dry heating at 130° C. for 10 min without load is 5% or less in an amount of 80 to 10% by weight.

16. The pile composition as claimed in claim 13, further comprising a low shrinkable acrylic fiber whose shrinkage rate after dry heating at 130° C. for 10 min without load is 5% or less in an amount of 80 to 10% by weight.

17. A pile fabric prepared from the pile composition as claimed in claim 11.

18. A pile fabric prepared from the pile composition as claimed in claim 12.

19. A pile fabric prepared from the pile composition as claimed in claim 13.

20. A pile fabric prepared from the pile composition as claimed in claim 14.

21. A pile fabric prepared from the pile composition as claimed in claim 15.

22. A pile fabric prepared from the pile composition as claimed in claim 16.

* * * * *